US007137236B2

(12) United States Patent
Brownlie

(10) Patent No.: US 7,137,236 B2
(45) **Date of Patent: *Nov. 21, 2006**

(54) INTERFACE PADS WITH PROPORTIONAL VALVES

(76) Inventor: Alan W. Brownlie, 532 E. Log Hill Rd., Pagosa Springs, CO (US) 81147-1690

( * ) Notice: Subject to any disclaimer, the term of this patent is extended or adjusted under 35 U.S.C. 154(b) by 278 days.

This patent is subject to a terminal disclaimer.

(21) Appl. No.: 10/730,502

(22) Filed: Dec. 8, 2003

(65) Prior Publication Data

US 2004/0244340 A1 Dec. 9, 2004

Related U.S. Application Data

(63) Continuation-in-part of application No. 10/219,715, filed on Aug. 15, 2002, now Pat. No. 6,658,827.

(60) Provisional application No. 60/312,479, filed on Aug. 15, 2001.

(51) Int. Cl.
*B68C 1/10* (2006.01)
*B68B 3/08* (2006.01)

(52) U.S. Cl. ..... 54/66; 54/68; 54/44.5

(58) Field of Classification Search ..... 54/44.5, 54/65, 66, 68; 251/208
See application file for complete search history.

(56) References Cited

U.S. PATENT DOCUMENTS

| | | | | |
|---|---|---|---|---|
| 3,466,852 | A | 9/1969 | Stoner | 54/65 |
| 3,988,790 | A | 11/1976 | Mracek et al. | 5/86 |
| 4,025,974 | A | 5/1977 | Lea et al. | 5/367 |
| 4,127,906 | A | 12/1978 | Zur | 5/66 |
| 4,171,004 | A | 10/1979 | Cerrato et al. | 137/116 |
| 4,624,277 | A | 11/1986 | Veite | 137/116.3 |
| 4,696,320 | A | 9/1987 | Bull | 137/116.5 |
| 4,962,921 | A | 10/1990 | Simmons | 272/1 B |
| 4,979,249 | A | 12/1990 | Meade, II | 5/441 |
| 5,027,589 | A | 7/1991 | Gleb et al. | 54/66 |
| 5,079,873 | A | 1/1992 | Smith | 49/477 |
| 5,119,618 | A | 6/1992 | Streck | 54/66 |
| 5,191,752 | A | 3/1993 | Murphy | 54/44.5 |
| 5,249,318 | A | 10/1993 | Loadsman | 5/453 |
| 5,282,286 | A | 2/1994 | MacLeish | 5/564 |
| 5,330,249 | A | 7/1994 | Weber et al. | 297/214 |
| 5,363,631 | A | 11/1994 | Garrison | 54/66 |
| 5,452,741 | A | 9/1995 | Tomita et al. | 137/505.26 |
| 5,456,072 | A | 10/1995 | Stern | 54/44.5 |

(Continued)

*Primary Examiner*—Robert P. Swiatek
*Assistant Examiner*—Elizabeth Shaw
(74) *Attorney, Agent, or Firm*—Brown & Michaels, PC

(57) ABSTRACT

These interface pads with proportional valves have at least one inflatable member having a foam core with a cell structure that absorbs atmospheric air. The transmission of air into the foam core is controlled by a valve in said opening. Fasteners are used to affix this inflatable member in a location where it can serve as an interface pad between a living creature and another object. The valve used is a proportional valve adjustable to different pressure settings, where the different pressure settings allow air to escape from the valve until the set pressure is reached. In one preferred embodiment, there are two inflatable members adapted for placement adjacent the upper sides of a load-bearing animal. An important subcategory of this embodiment covers bareback riding pads, including bareback riding pads for use by handicapped persons. In other embodiments, at least one inflatable member is adapted to pad an interface between a human and an object. Where the object is a seat, the fasteners are adapted for affixing inflatable member(s) to a seat. Where the object is a prosthetic, the pad is adapted to pad the interface between human and prosthetic, and the fasteners are adapted for affixing inflatable member(s) in position with respect to the prosthetic.

27 Claims, 14 Drawing Sheets

U.S. PATENT DOCUMENTS

| | | | | |
|---|---|---|---|---|
| 5,561,873 | A | 10/1996 | Weedling | 5/711 |
| 5,575,139 | A | 11/1996 | Green | 54/66 |
| 5,595,209 | A | 1/1997 | Atkinson et al. | 137/116.5 |
| 5,782,070 | A | 7/1998 | Knight et al. | 54/66 |
| 5,787,692 | A | 8/1998 | Purdy | 54/66 |
| 5,802,823 | A | 9/1998 | Woods | 54/66 |
| 5,834,543 | A | 11/1998 | Garrison | 524/198 |
| 5,934,280 | A | 8/1999 | Viard et al. | 128/845 |
| 6,050,067 | A | 4/2000 | Knight et al. | 54/44.6 |
| 6,065,273 | A | 5/2000 | Schneider | 54/66 |
| 6,125,616 | A | 10/2000 | Brown | 54/66 |
| 6,209,578 | B1 | 4/2001 | Newton | 137/505.41 |
| 6,370,850 | B1 | 4/2002 | Zilka | 54/65 |
| 6,415,583 | B1 | 7/2002 | Landi et al. | 54/65 |
| 6,421,989 | B1 | 7/2002 | Leson | 54/66 |
| 6,658,827 | B1 * | 12/2003 | Brownlie | 54/66 |

* cited by examiner

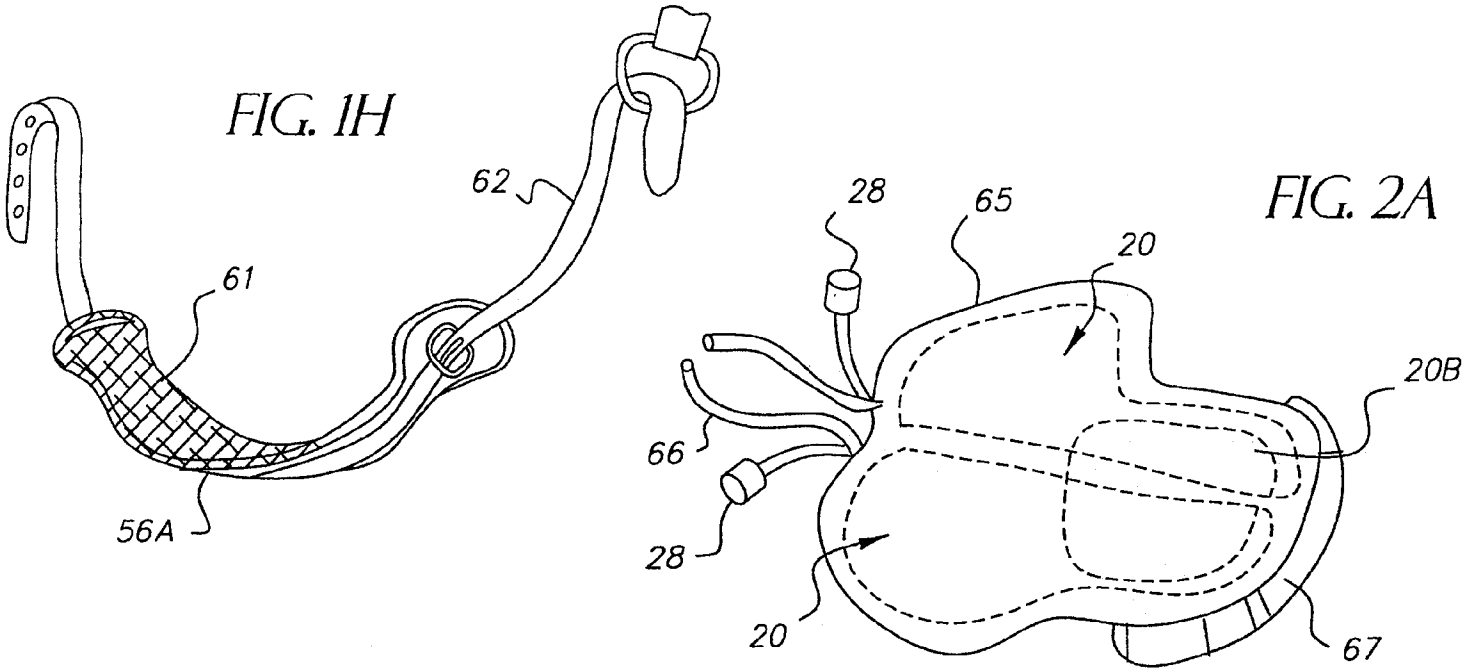
FIG. 2A
FIG. 1H
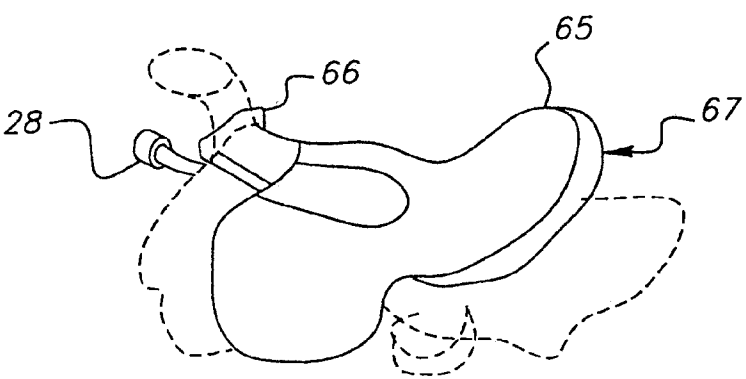
FIG. 2B

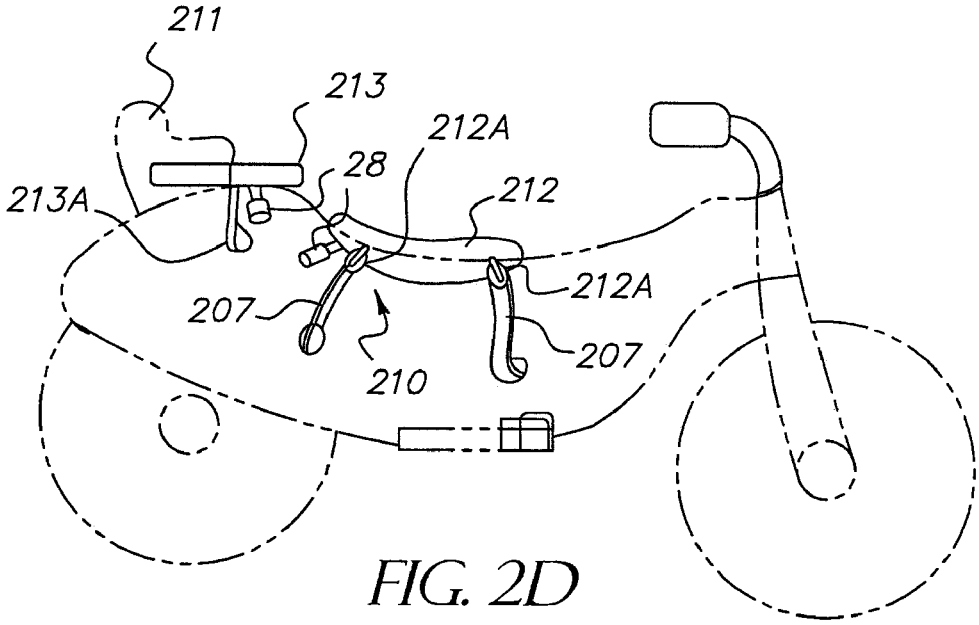
FIG. 2D
FIG. 2G
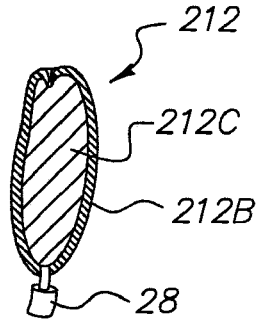
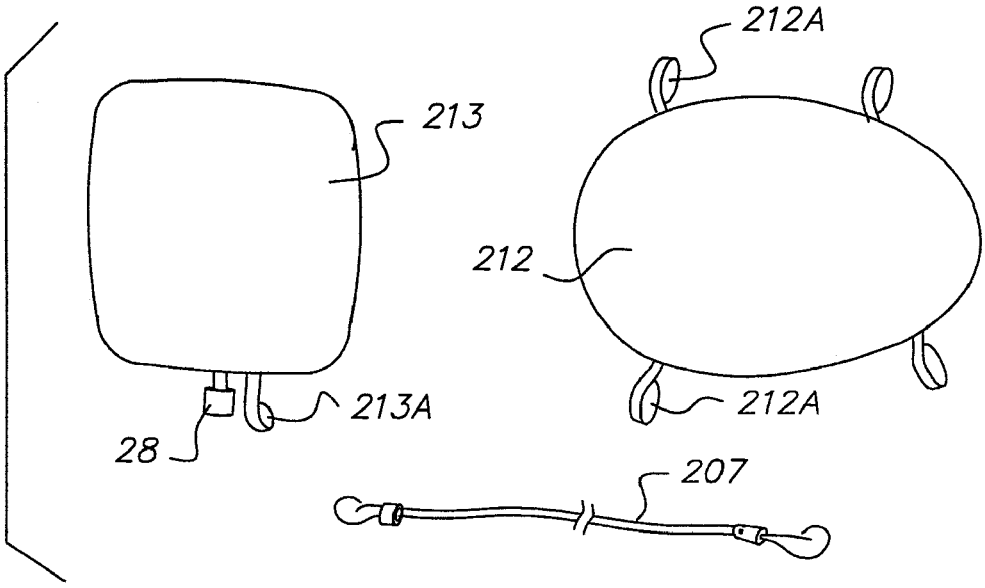
FIG. 2F

INTERFACE PADS WITH PROPORTIONAL VALVES

This application claims the benefit of U.S. Provisional Application No. 60/312,479, filed on 15 Aug. 2001, and is a CIP of U.S. Non-provisional application Ser. No. 10/219,715, filed Aug. 15, 2002 now U.S. Pat. No. 6,658,827, which applications and patent are incorporated by reference herein.

TECHNICAL FIELD

My invention pertains generally to the field of interface pads used to pad the interface between an animal or human and a saddle, seat, or other implement. More particularly, it is concerned with interface pads having (i) a foam core wholly surrounded by and bonded to a pair of thin skins or panels so as to form a fluid tight envelope with (ii) a valve that is preferably a proportional valve disposed between the chamber formed by the envelope and the ambient environment.

BACKGROUND

It is a recognized fact that most saddles do not fit most horses. Production saddles are made to fit a size and type of horse and rider in general. However, no horse is completely symmetrical. All have some unevenness of frame and proportion that can lead to an improper fit and interface between horse and saddle. This can, in turn, lead to discomfort and injury to the horse. Even custom saddles made to suit exacting measurements taken from a standing animal may not fit properly after the animal is cinched to secure the saddle, is mounted and adapts to the load, and then moves under the load. Further, the contour of the horse's back changes as it turns and moves about. Thus, even a saddle that fits properly when the horse is at rest may cause problems when the horse is in motion. In addition to this, the rider's weight may be unevenly distributed and may shift during riding. Finally, not all saddles are properly balanced and symmetrical. Some are produced with defects and some can become warped or crooked with use.

Given the foregoing facts, it is almost imperative to provide some type of saddle pad (or "interface") between saddle and horse in order to mediate the differences, and soften contact, between the horse's back and the lower surfaces of the saddle. In my patent issued Dec. 9, 2003, for "Interface Pads" (U.S. Pat. No. 6,658,827) I developed and described ideal animal/saddle and rider interfaces that were durable and included, in various embodiments, the following features: (1) means for automatically alleviating and mediating mismatches between a saddle or saddle tree and a load-bearing animal so that the entire load is distributed evenly over the length of the tree on both sides; (2) means for automatically compensating for differences between the two sides of the animal so as to equal and level the animal's load; (3) means for automatically distributing and/or otherwise compensating for uneven static or dynamic side-to-side and front-to-back loads such as those caused by unequal conformation or loading or movement of the rider; (4) means for automatically absorbing and distributing shock and vibration while traveling; (5) means for automatically adjusting each of the foregoing when necessary due to environmental changes (e.g.—air pressure changes) or load changes; (6) means for reducing or eliminating slippage of the interface on the horse or saddle on the interface; (7) means for avoiding contact with the spinal area of the horse; (8) means for encouraging and allowing the free circulation of air in and through the gullet of the saddle; (9) means for expediting the evaporation of perspiration and moisture from the horse and interface including means for making the pad as thin as possible; and (10) means for automatically adapting to the movement of the animal in flexing and turning.

The interface pads of my invention, according to one preferred embodiment of the invention, are comprised of at least a first and a second discrete inflatable member directly or indirectly linked to one another. The volume of air in each of these inflatable members is capable of independent adjustment. For convenience, the first member is referred to as the left member and the second member is referred to as the right member. The right member is adapted to provide an interface between the right side of a load-bearing animal and the right portion of a load-supporting structure such as a saddle. The left member is adapted to provide an interface between the left side of the load-bearing animal and the left portion of the load-supporting structure. Connecting means are provided to span the spinal area of the animal so as to mechanically link the first and second members to one another.

In one embodiment, the connecting means is a separate component subsequently integrated into or onto the inflatable members such as by attaching one or more straps or clips to each inflatable member. In another embodiment, the connecting means is an integral component, such as the flexible panels used to create the inflatable members, which spans from one member to the other member. In still another embodiment, the connecting means is an auxiliary non-integrated component wherein the connection between inflatable members is by way of a receiving structure adapted to individually receive each inflatable member. These receiving structures can be shaped to fit under various types of saddles and/or to serve as a bareback pad.

To overcome many of the drawbacks of the prior art, the inflatable members of my invention are constructed of a foam core wholly surrounded by and bonded to a pair of thin skins or panels, which form a fluid tight envelope. A valve is disposed between the chamber formed by the envelope and the ambient environment. This innovation is critical to the proper functioning of my invention. Prior air pads have featured air chambers that were empty or enclosed a loosely fitting core of foam or some other material. Bonding the core to the outer walls of the chamber means that air entering and leaving the chamber must filter slowly through the foam core rather than rushing around its periphery. This, in turn, allows the air pad to provide valuable quasi-orthotic benefits. Thus, for example, after allowing inflation of an air pad of this type and inserting the air pad between saddle and horse, the valve can be opened. In this situation, the air pad will conform to the contours and configuration of both saddle and horse until it reaches a point where the pressure exerted by foam and air remaining in the foam matches the exterior pressure placed on its various parts. The valve is then closed. When the air pad is removed and examined, it will be seen to have taken a shape and configuration conforming to the contours and configuration of horse and saddle. If the valve remains closed, the air pad will retain this orthotic configuration for an extended period of time. Yet, it is relatively flexible and remains capable of adjusting as necessary to the turning and active movements of the horse and the shifting movements of the load being carried.

Even given the innate benefits of my design as set forth above, I have also found that the inclusion of proportional valves is extremely advantageous for the purposes of my invention. The proportional valve of my invention is, generally speaking, a spring-loaded valve that can be adjusted to different degrees of tightness. At its tightest setting, only a heavy load (or rider) will be sufficient to displace the spring-biased plug for the valve and allow air to exit the pad. At its lightest setting, the moderate pressure exerted on the air pad by a light load (or rider) will accomplish this result. The inclusion of proportional valves allow my pads to function more efficiently with loads (or riders) of different weights. For example, with an ordinary valve, it is possible that a very heavy rider could compress the air pads almost completely over some critical pressure points. In this situation, the air pads would cease to function for their intended purpose in the most efficient manner. However, with proportional valves adjusted to a setting based on the rider's weight, this problem will not occur. The valves will not allow as much air to escape when a heavier load is placed on the air pads, preserving the cushioning function and quasi-orthotic benefits of my invention.

In addition to the advantages discussed above, the inclusion of proportional air valves has another important benefit: they are virtually automatic. Without such valves, it is necessary for the rider to initially open the air valves to allow air to escape from full air pads so that the air pads can assume the desired molded/orthotic configuration. The non-proportional air valves are then closed to fix the air pads in this configuration. (Usually this procedure is followed after initially cinching the saddle into place, re-cinching the saddle for tightness, and mounting the horse.) However, with a proportional air valve, the adjustment process becomes almost fully automatic. After initially setting the air valves for the desired load, the rider need take no further action. The air pads will let the desired amount of air escape automatically when the rider cinches the saddle into place and mounts.

In addition to the changes and improvements set forth above, I have found it very advantageous to form the pads of my invention from breathable moisture wicking materials that allow perspiration to freely evaporate and aid in cooling. I have also found it advantageous to form the surfaces of these pads from a breathable non-slip material that has never been used in this type of application. A material formed from a polyester mesh with polyvinylchloride (PVC) coating bonded to felt is ideal for this purpose. This material, which was previously used for making weightlifter's gloves, provides excellent non-slip traction for the pads of my invention without inhibiting the free flow of air and other desirable characteristics of the moisture wicking materials I use in making my pads. This non-slip material is currently produced and sold under the brand name TOUGH TEK. It is, in addition, very useful in creating non-slip straps for use with my invention.

The types of tough durable inflatable members preferred for use as air pads in my invention are presently produced by Cascade Designs, Inc. of Seattle, Wash., under the trademark THERM-A-REST. The nature of the inflatable members can be varied depending upon the environment in which the invention will be exposed. For example, the inflatable member can use a homogenous core such as the type disclosed in U.S. Pat. Nos. 4,624,877 and 4,025,974 or can use a composite core such as disclosed in U.S. Pat. No. 5,282,286, all of which are incorporated herein by reference. Moreover, other cores can be used as long as the core includes tensile elements therein that, when bonded to the pair of thin skins or panels, resist displacement of the skins when the pad is subject to compression. However, cores that slow the movement of air in, out, and through the pad are preferred.

Finally, in addition to the uses specified above, the inflatable members of my invention can be used and are claimed in my patent for use as seat pads (with the addition of means to hold inflatable member(s) in position on a seat). However, numerous other possibilities inherent in my invention for equine and human use remain.

SUMMARY OF THE INVENTION

My invention is comprised of at least one inflatable member having a foam core with a cell structure that absorbs atmospheric air, which foam core is wholly surrounded by and bonded to a thin skin which forms a fluid tight envelope around said foam, which thin skin has an opening for transmitting air between the foam core and the atmosphere, which transmission of air is controlled by a valve in said opening. Fasteners are used to affix this at least one inflatable member in a location where it can serve as an interface pad between a living creature and another object. Its objects and goals are further served by the use of a proportional valve, the proportional valve being adjustable to different pressure settings, which different pressure settings allow air to escape from the valve until the set pressure is reached.

In one preferred embodiment, there are two inflatable members, a left inflatable member adapted for placement between a left upper side of a load-bearing animal and a load resting on that side and a right inflatable member adapted for placement between a right upper side of the load-bearing animal opposite said left side and a load resting on that side. In this embodiment, a top connection can be provided linking said left inflatable member and said right inflatable member across an upper portion of the load-bearing animal such that said left inflatable member and said right inflatable member hang over said upper portion adjacent, respectively, the left and right upper sides of the load-bearing animal, said top connection being provided by portions of receiving structures holding said left inflatable member and said right inflatable member. And, areas covered by said receiving structures conform to a shape appropriate for a particular equine activity such as one of show riding, dressage riding, endurance riding, western riding, barrel racing, roping, racing, hunting, jumping, steeplechase, bareback riding, handicapped riding, pack horse, paraplegic riding, therapeutic riding, and English riding.

An important subcategory of this embodiment covers bareback riding pads, including bareback riding pads for use by handicapped persons. In bareback riding pads, a strap member must be provided for connecting said receiving structures underneath a load-bearing animal and holding the receiving structures in position on the load-bearing animal. Thus, such pads must have connection points for the strap member. They can also be advantageously provided with stirrups and/or with a connector adapted to bridge the load-bearing animal's withers, which connector is provided with structural reinforcement and can be used as a hand hold. A handle can also be provided between the connector and the top connection. In another important subcategory, an expanded skirt is added. This expanded skirt holds side inflatable members adapted for placement adjacent lower sides of the load-bearing animal. This can be important in therapeutic riding endeavors with handicapped, spastic, or emotionally disturbed riders, who often kick the sides of the horse in an uncontrolled or random manner.

In other embodiments, at least one inflatable member is adapted to pad an interface between a human and an object. Where the object is a seat, the fasteners are adapted for affixing the at least one inflatable member to a seat. For seats with backs, two inflatable members can be used, a lower inflatable member adapted for placement between the seat and the human resting on that seat and a back inflatable member adapted for placement between a back of the human and a back of the seat. The back inflatable member can be adapted to serve as a lumbar support. In these embodiments as in those set forth above, a receiving structure can be provided that is adapted to hold the inflatable members in correct position with respect to said seat. Typically, the inflatable member(s) and/or the receiving structures therefor will be shaped and adapted to cover areas appropriate to a particular type of seat such as one of a saddle, a vehicle seat, a wheelchair seat, a motorcycle seat and/or some other type of seat. Other embodiments are adapted to pad the interface between a human and a prosthetic, and the fasteners are adapted for affixing said at least one inflatable member in position with respect to said prosthetic.

DRAWINGS

FIG. 1A provides a view from above of an embodiment for use with a western saddle having receiving structures that are joined by a fixed web at the rear and that have an open front end with an optional adjustable strap for positioning adjacent the horse's withers.

FIG. 1B provides a cross-sectional view of the embodiment illustrated in FIG. 1A.

FIG. 1C provides a view from above of an embodiment for use with an English saddle having receiving structures that are joined by a fixed web at the rear and that have an open front end with an optional adjustable strap for positioning adjacent the horse's withers.

FIG. 1D provides a side view of an embodiment for use as a bareback saddle having means in the form of an aperture for receiving a strap and also has ties for making an adjustable connection over the animal's withers.

FIG. 1E provides a view from above of the embodiment shown in FIG. 1D.

FIG. 1F provides an exploded schematic cross-sectional view of one of the receiving structures shown in FIGS. 1D and 1E, illustrating the placement of various materials therein.

FIG. 1G provides a side view of an embodiment for use as a bareback saddle having means in the form of a "D" ring for receiving a strap.

FIG. 1H provides a perspective view of a strap incorporating the teachings of this invention.

FIG. 2A provides a view from above of a rider pad intended for placement between a rider and saddle.

FIG. 2B provides a perspective view of the rider pad of FIG. 2A in place on a saddle.

FIG. 2D illustrates an embodiment of my invention intended for use on motorcycles, snow mobiles, and other vehicles with tandem seating.

FIG. 2F illustrates an embodiment of my invention intended for use on motorcycles, snow mobiles, and other vehicles with tandem seating.

FIG. 2G provides a cross-sectional view of an embodiment of my invention intended for use on motorcycles, snow mobiles, and other vehicles with tandem seating.

Figure 3A:
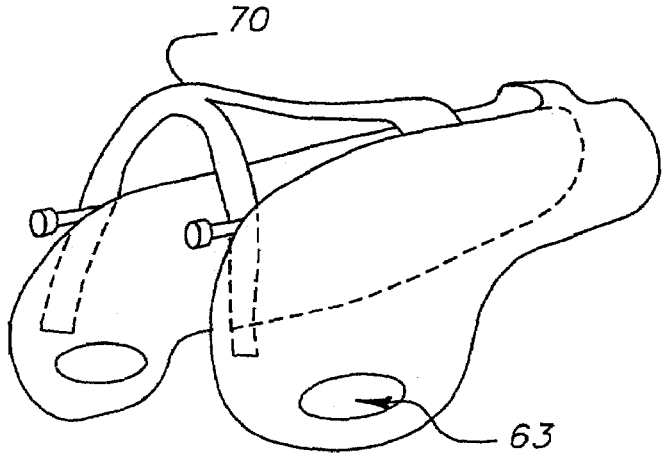

FIG. 3A provides a perspective view of an embodiment for use as a bareback saddle having a forward hand-hold formed by a connector bridging the animal's withers.

Figure 3E:
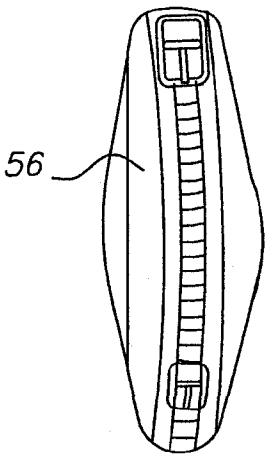
Figure 3F:
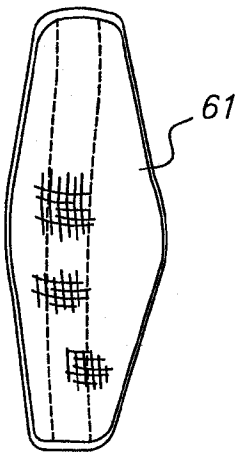
Figure 3G:
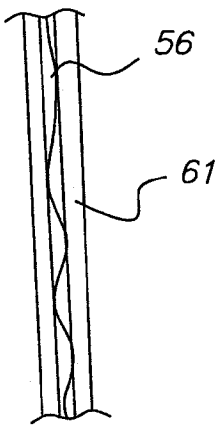
Figure 3B:
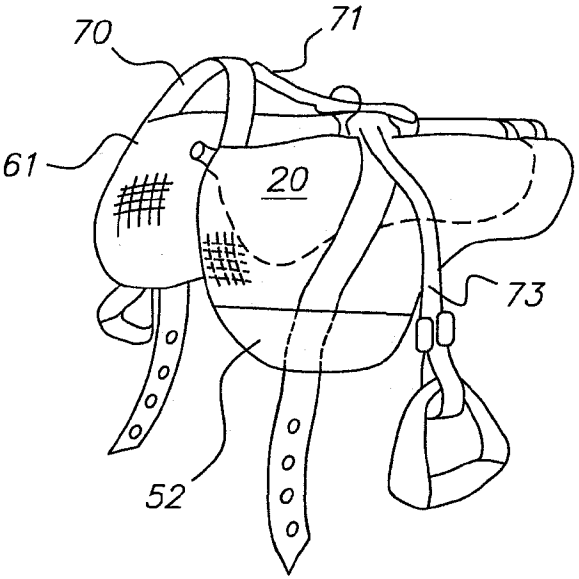

FIG. 3B provides further detail with regard to the embodiment illustrated in FIG. 3A.

Figure 3H:
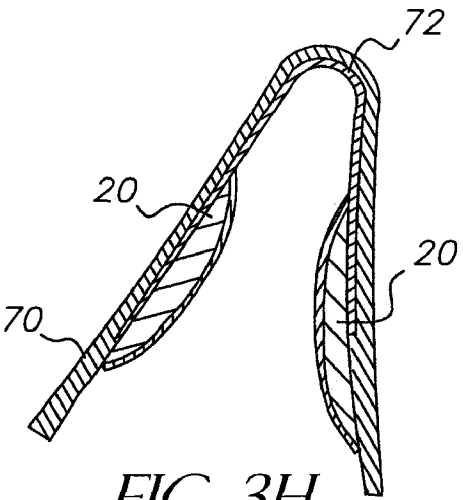
Figure 3I:
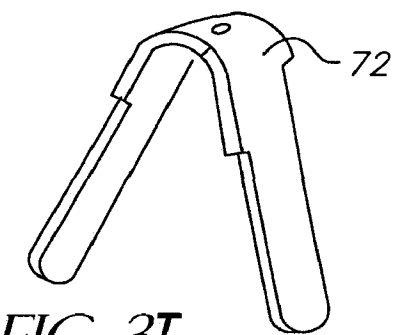
Figure 3C:
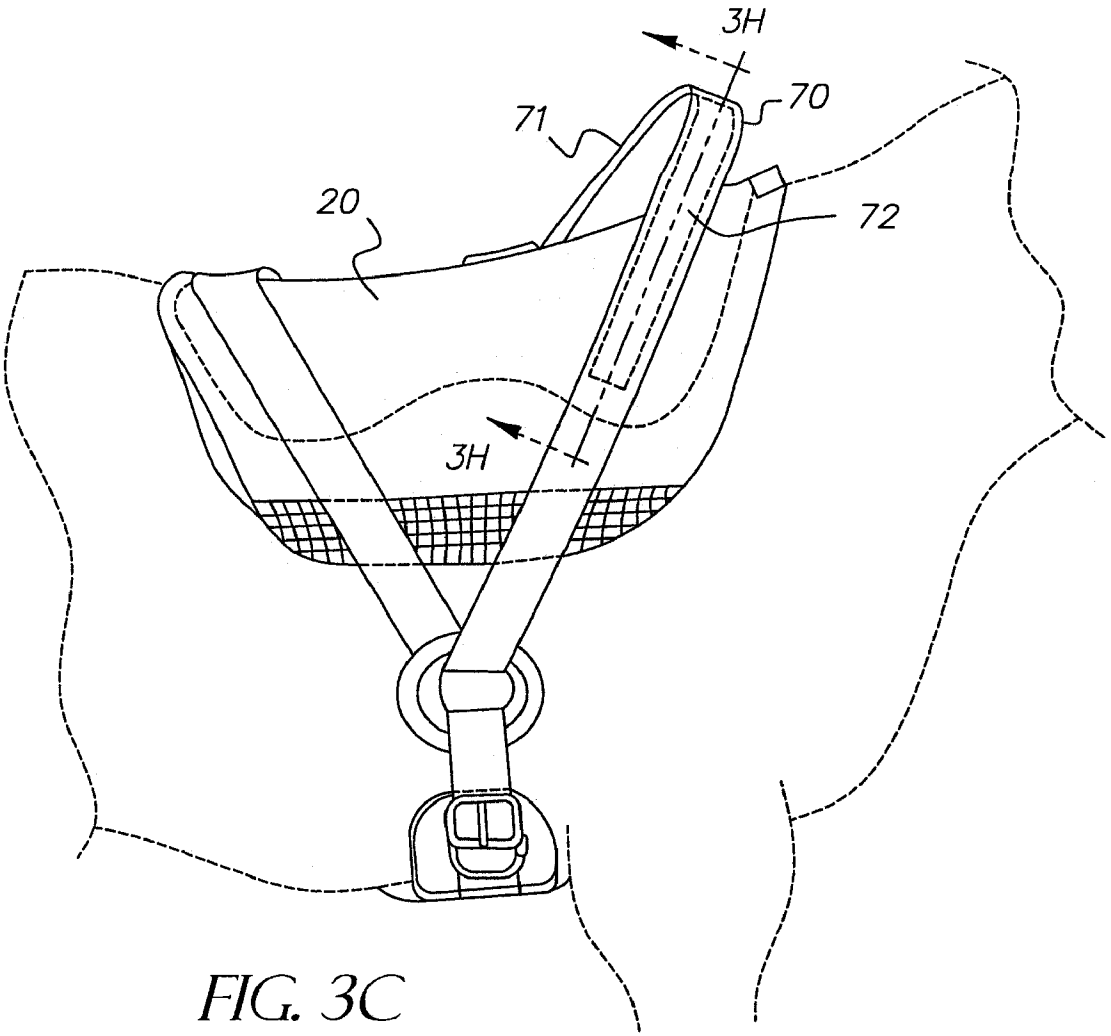

FIG. 3C provides further detail with regard to the embodiment illustrated in FIG. 3A.

Figure 3D:
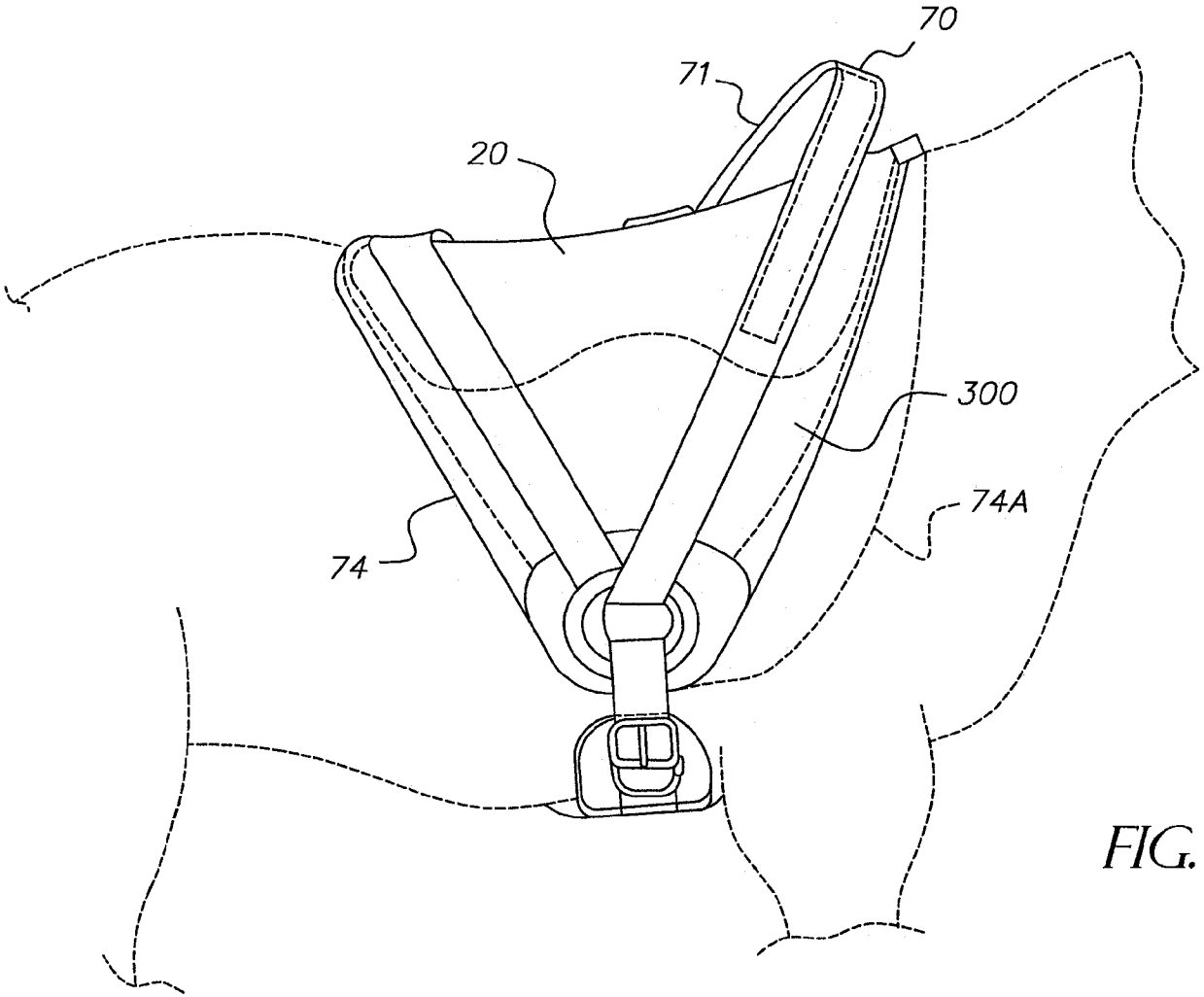

FIG. 3D provides a side view of an embodiment with an expanded skirt holding side inflatable members.

Figure 1A:
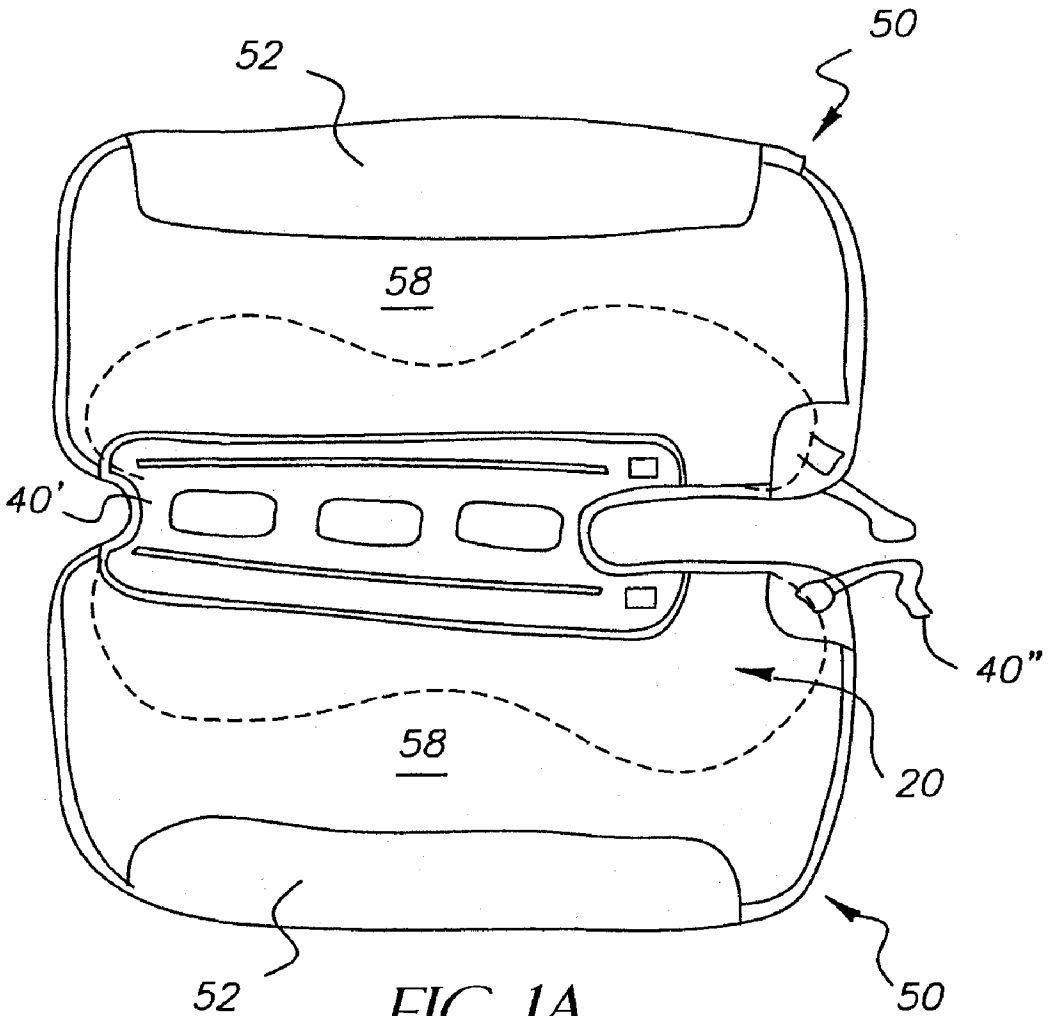
Figure 1B:
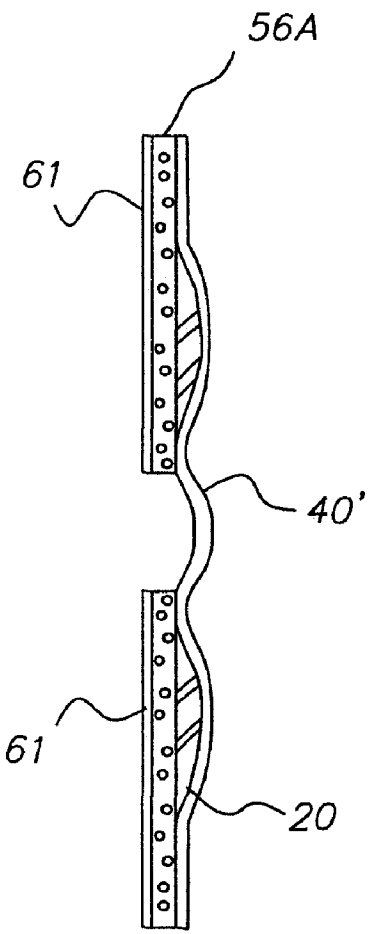

FIG. 3E provides an out-side view providing further detail with regard to the strap embodiment illustrated in FIG. 1H.

FIG. 3F provides an in-side view providing further detail with regard to the strap embodiment illustrated in FIG. 1H.

FIG. 3G provides a cross-sectional view providing further detail with regard to the strap embodiment illustrated in FIG. 1H.

FIG. 3H provides a cross-sectional view taken through 3H—3H of FIG. 3C.

FIG. 3I provides a detailed perspective view of the structural reinforcement fork illustrated in FIG. 3C.

Figure 4B:
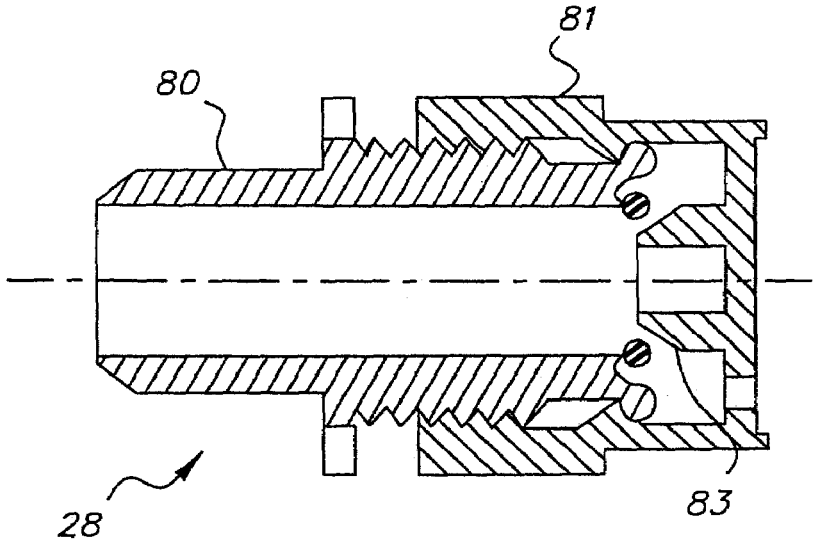
FIG. 4B (PRIOR ART)
Figure 4C:
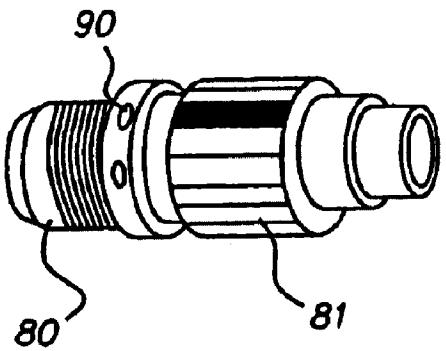
Figure 4A:
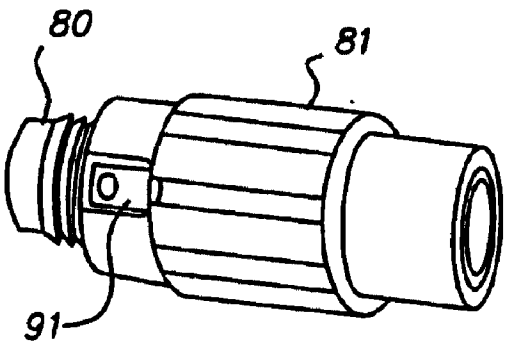
Figure 4A:
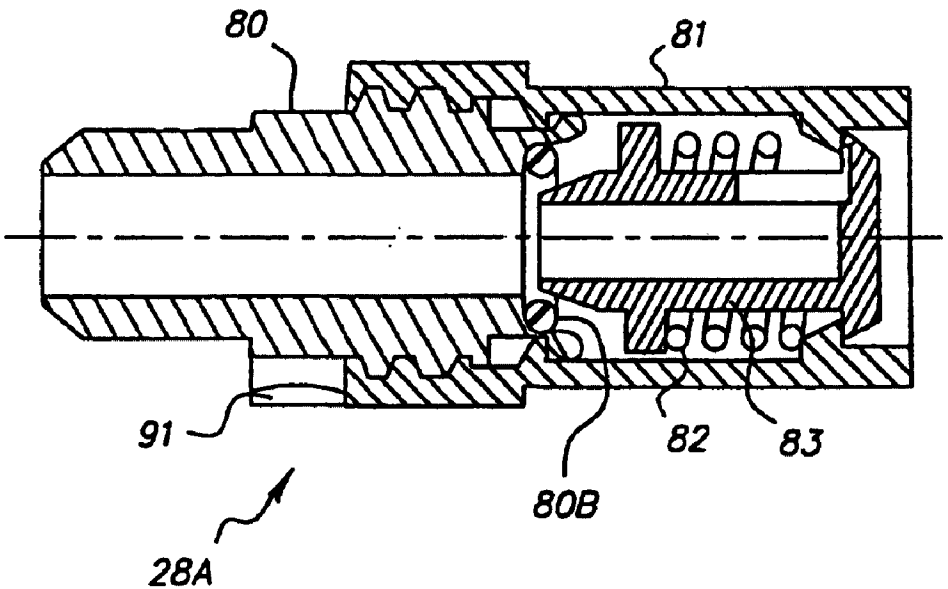

FIG. 4A provides a cross-sectional view of a proportional valve, while perspective details therefrom providing perspective views illustrating two indicator arrangements therefor.

FIG. 4B provides a cross-sectional view of an ordinary valve suitable for use with this invention.

FIG. 4C provides a cross-sectional view of another proportional valve.

Figure 4E:
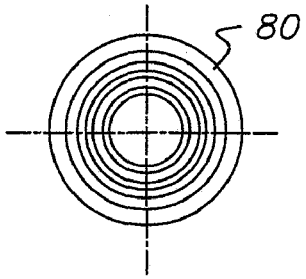
Figure 4D:
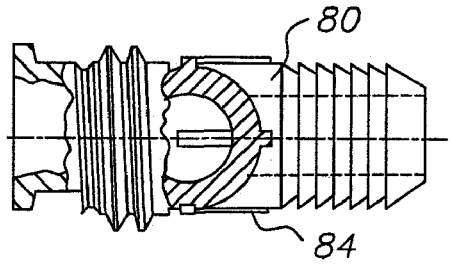

FIG. 4D provides details related to the proportionate valve illustrated in FIG. 4C.

FIG. 4E provides details related to the proportionate valve illustrated in FIG. 4C.

Figure 4G:
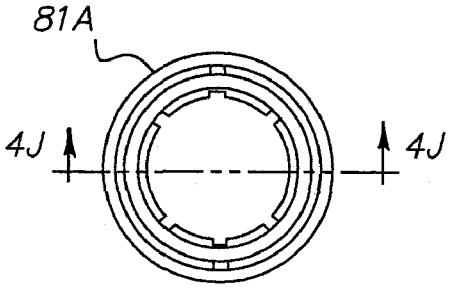
Figure 4F:
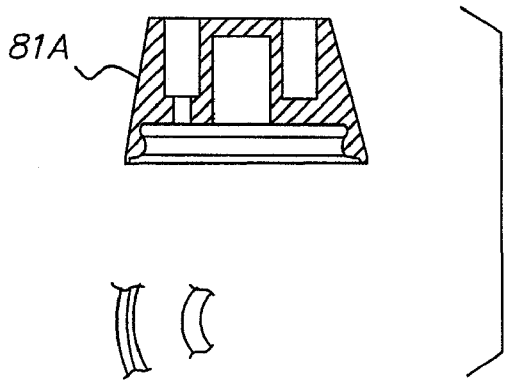

FIG. 4F provides details related to the proportionate value illustrated in FIG. 4C.

FIG. 4G provides details related to the proportionate valve illustrated in FIG. 4C.

Figure 4J:
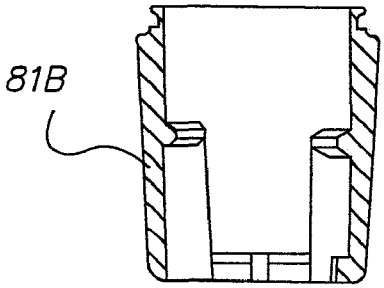
Figure 4H:
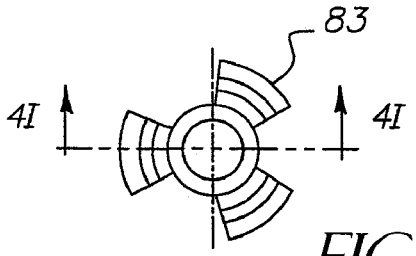

FIG. 4H provides details related to the proportionate valve illustrated in FIG. 4C.

Figure 4I:
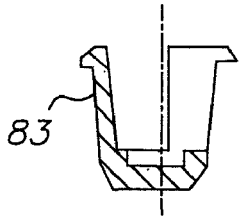

FIG. 4I provides a cross-sectional view taken through 4I—4I of FIG. 4H.

FIG. 4J provides a cross-sectional view taken through 4J—4J of FIG. 4G.

Figure 5B:
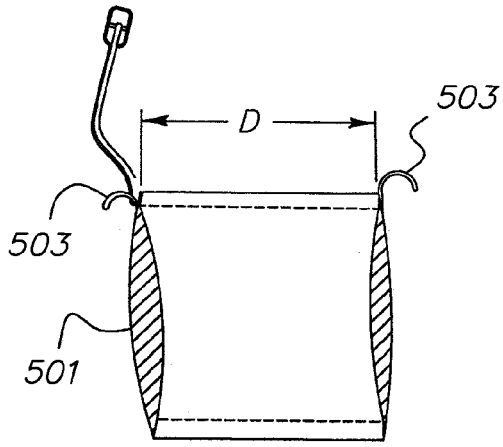
Figure 5A:
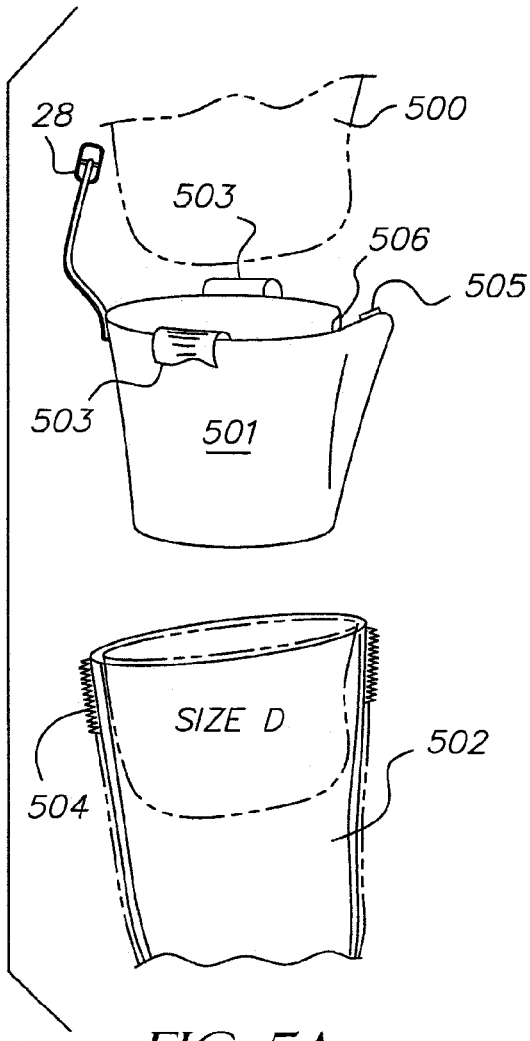

FIG. 5A illustrates an embodiment of my invention adapted for use in padding the interface between a person and a prosthetic device.

FIG. 5B provides a cross-sectional view of an embodiment of my invention adapted for use in padding the interface between a person and a prosthetic device.

Figure 5C:
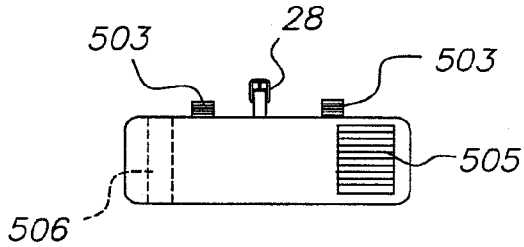

FIG. 5C provides an un-wrapped view of an embodiment of my invention adapted for use in padding the interface between a person and a prosthetic device.

Figure 6:
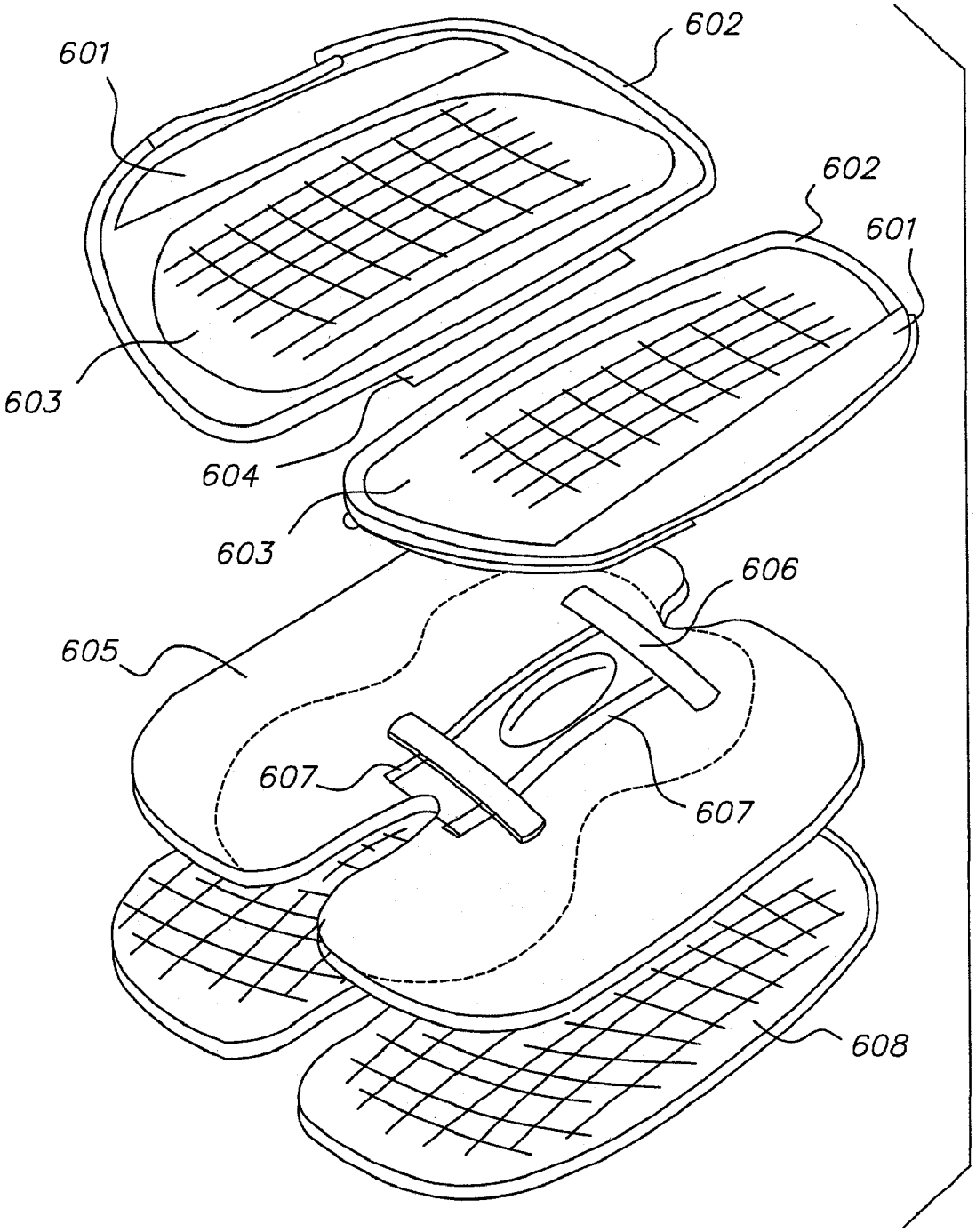

FIG. 6 provides an exploded perspective view of my invention illustrating a preferred construction thereof.

DETAILED DESCRIPTION

The following discussion is presented to enable a person skilled in the art to make and use the invention. Various modifications to the preferred embodiment will be readily apparent to those skilled in the art, and the generic principles herein can be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

Turning then to the several Figures, and more particularly to FIGS. 1A through 1G, a basic form of a preferred embodiment is shown. Each pad system comprises a pair of inflatable members 20 linked by a connection means forming a top connection. Each inflatable member 20 has a foam core wholly surrounded by and bonded to a pair of outer panels (or thin skins) to form a fluid tight envelope. Valve 28 is disposed between the chamber formed by the envelope and the ambient environment. Preferably, the construction of each member 20 is accomplished by coating one side of each outer panel with a thermoplastic material, placing respective cores between the coated panels, compressing the assembly under heat to cause portions of the cores to bond with portions of the panels, sealing the perimeters of the panels adjacent to the core to one another while including one valve 28 for each formed envelope. Further disclosure regarding this technology can be found in U.S. Pat. Nos. 4,624,877 and 4,025,974, which again are incorporated herein by reference.

Selection of the components that comprise each inflatable member 20 should be made in view of the environment in which the pad system will be used. If an inflatable member 20 is to be used without integration into an existing pad or blanket, then the outer should be durable and should be capable of collecting moisture (i.e.—have water-wicking capabilities) and disbursing it by evaporation. This quality can be provided by adding a layer of water-wicking material to the outer surface(s) of the inflatable member 20. If inflatable member 20 will be subjected to non-uniform loads (particularly point loading), it may be beneficial to use a heterogeneous core having various Indentation Force Deflection value elements as taught in U.S. Pat. No. 5,282,286, which is again incorporated by reference herein.

Figure 1C:
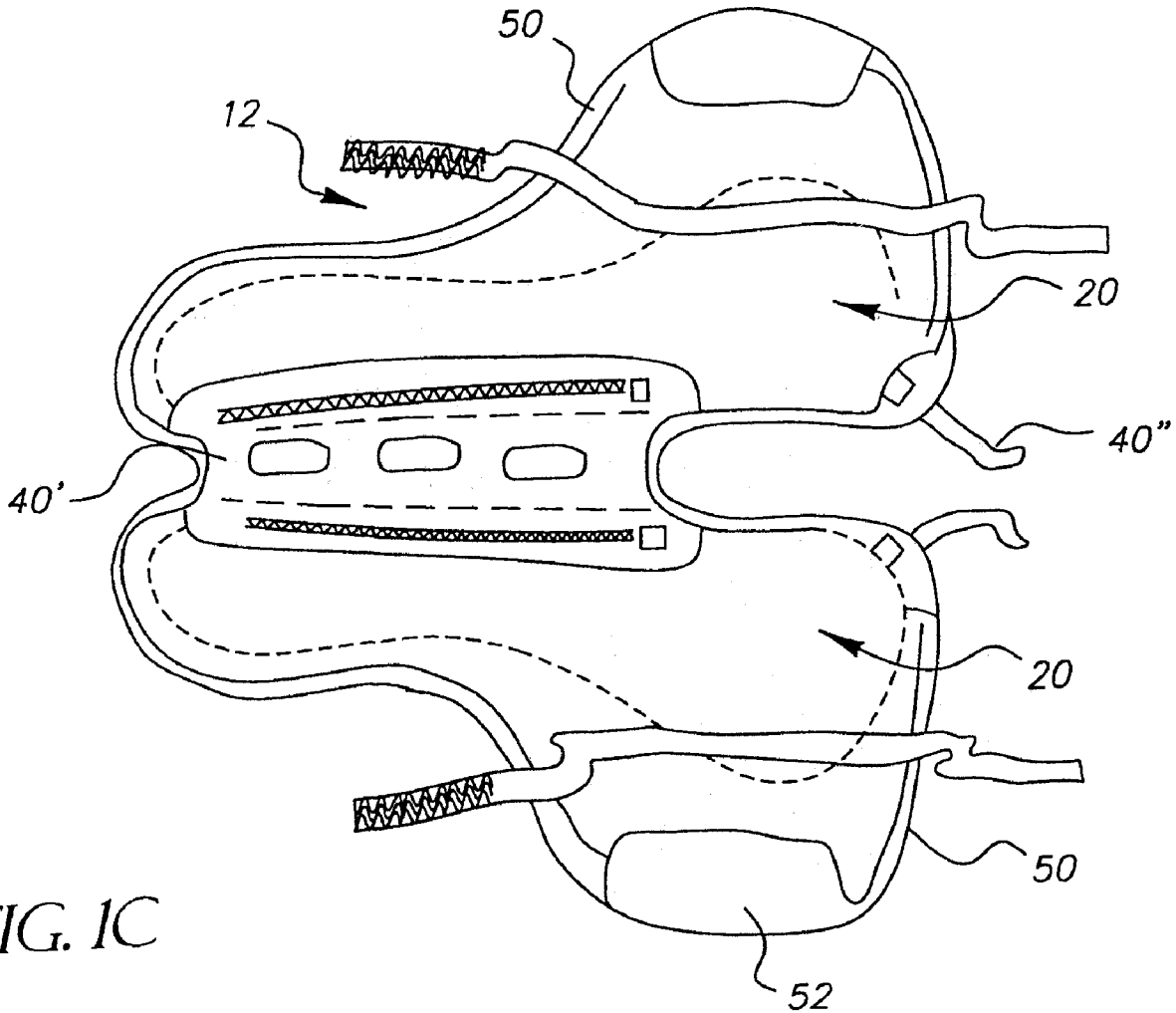
Figure 1D:
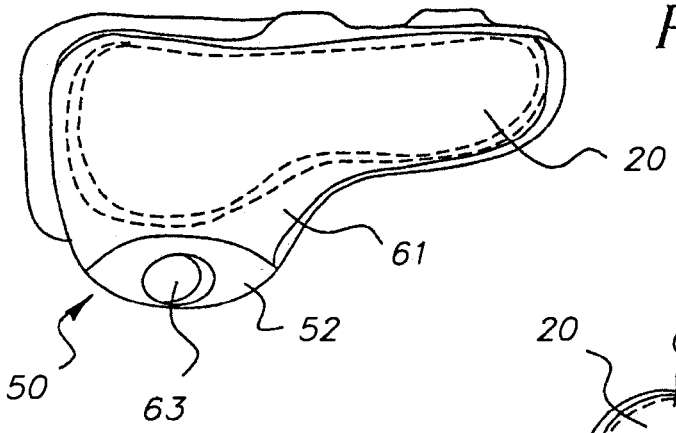
Figure 1E:
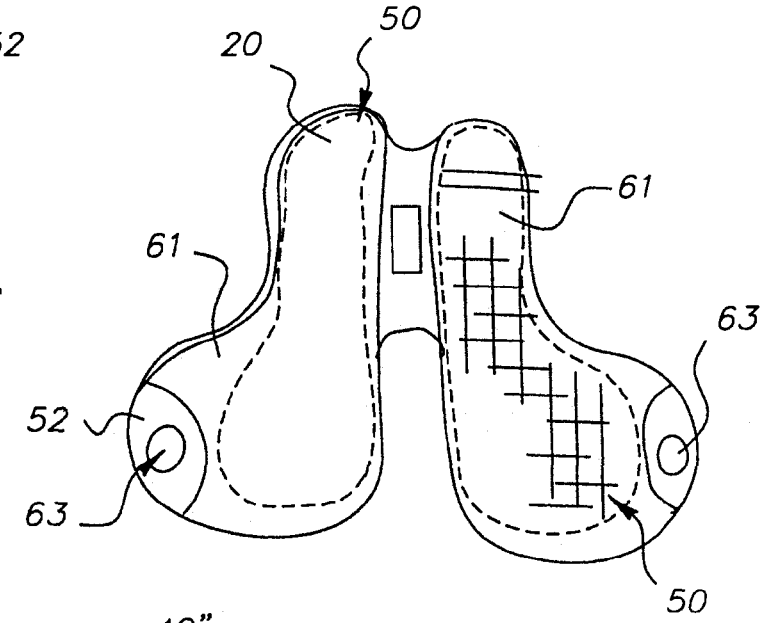
Figure 1F:
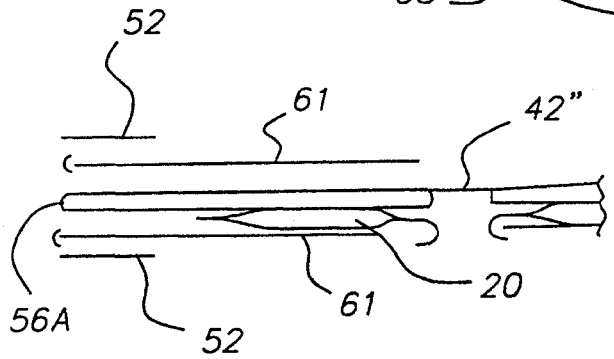
Figure 1G:
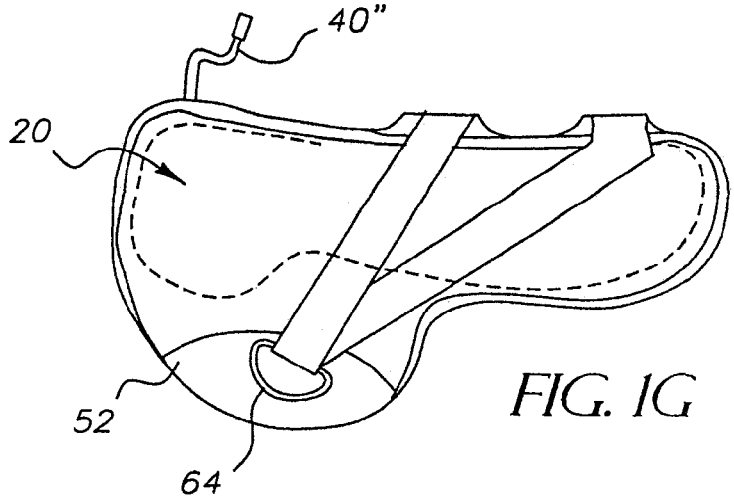

Each inflatable member 20 is preferably a custom-formed THERM-A-REST style self-inflating pad. The custom formation is directed primarily to the intended interface of the system. Thus, if a western saddle is contemplated, then each member 20 will have perimeter contours for the saddletree of such a saddle. (See, e.g., FIG. 1A.) If an English saddle is contemplated, then each member 20 will have perimeter contours for the saddletree of such a saddle, as is best shown in FIG. 1C. Although preferred, adaptation of the invention to suit the intended saddletree is not required.

To form a saddle pad system 12 of the type illustrated in FIGS. 1A through 1G, inflatable members 20 are inserted into pockets in receiving structures 50. By establishing a saddle pad system 12, the benefits associated with each approach are realized as will be appreciated by those persons skilled in the art. In particular, receiving structures 50 provide inflatable members 20 with increased protection from the elements, provide the animal with greater comfort, and positively locate inflatable members 20 on the animal so as to minimize unintentional dynamic changes that might otherwise occur during use. They can also be made to conform to a shape appropriate for a particular equine activity such as one of show riding, dressage riding, endurance riding, western riding, barrel racing, roping, racing, hunting, jumping, steeplechase, bareback riding, handicapped riding, pack horse, paraplegic riding, therapeutic riding, and English riding. In addition, inflatable members 20 are easily removable for cleaning, repair, or replacement. Finally, the presence of said pockets provides a location where magnets can be inserted if desired for their therapeutic effects.

Receiving structures 50 have durable strips 52 of leather for high wear areas; a horse-facing side 56 of felt 56A for cushioning, air passage, and sweat removal; a saddle-facing side 58 of felt 56A or other similar material for sweat absorption, heat passage, air passage, and evaporation; and straps 60 or an alternate top connection so as to form saddle pad system 12. Regardless of the composition of receiving structures 50, it is primarily necessary that they define a suitably sized and positioned pocket for receiving an inflatable member 20 when saddle pad system 12 is placed on a load-bearing animal. In order to ensure that system 12 maintains its proper position, I have found that it is very desirable to apply a breathable non-slip material 61 to the surfaces of receiving structures 50. This material can advantageously be formed from a polyester mesh with polyvinylchloride (PVC) coating bonded to felt and is ideal for this purpose when positioned with its mesh side facing outward. It provides excellent non-slip traction for the saddle pad system 12 of my invention without inhibiting the free flow of air and other desirable characteristics of the resilient moisture wicking material (wood-based felt) I use in making my pads. This non-slip material 61 is currently produced and sold under the brand name TOUGH TEK. It is, in addition, very useful in creating non-slip straps 62 for use with my invention as illustrated in FIG. 1H.

An important subcategory covers bareback riding pads, including bareback riding pads for use by handicapped persons. As illustrated in FIGS. 1D through 1G and FIGS. 3A through 3I, a bareback pad requires the addition of means-such as a strap 62 of the type shown in FIG. 1H—to hold it in position on the horse. It can use a circingle with the circingle held in place by a reinforcing strip 52 as shown in FIG. 3B. Optionally, it can be provided with some point of attachment such as an aperture 63 or a "D" ring 64 for use with an existing strap. It can also have a connector 70 adapted to bridge the animal's withers and serve as a hand-hold. Connector 70 can be advantageously provided with a handle 71 between the connector and the top connection and/or and a reinforcement member 72 for further support. Bareback pads can also be advantageously provided with stirrups 73. In another important subcategory, an expanded skirt 74 with optional forward shape 74A is added. This expanded skirt 74 holds side inflatable members 300 adapted for placement adjacent lower sides of the load-bearing animal. This can be important in therapeutic riding endeavors with handicapped, spastic, or emotionally disturbed riders, who often kick the sides of the horse in an uncontrolled or random manner.

In other embodiments, at least one inflatable member 20 is adapted to pad an interface between a human and an object. Where the object is a seat, fasteners are provided for affixing the inflatable member 20 to the seat. A first example is illustrated in FIGS. 2A and 2B, where my invention is configured as a seat pad 65 for a rider with the addition of means to hold it in position on a saddle or seat. Such means can take the form of a strap or loop 66 that can fasten around the horn of a saddle and an elastic cantle attachment 67 for fastening at the rear of the saddle. (In this option, an inflatable member can be used to form a single butt pad for use with or without other such members.)

Figure 2C:
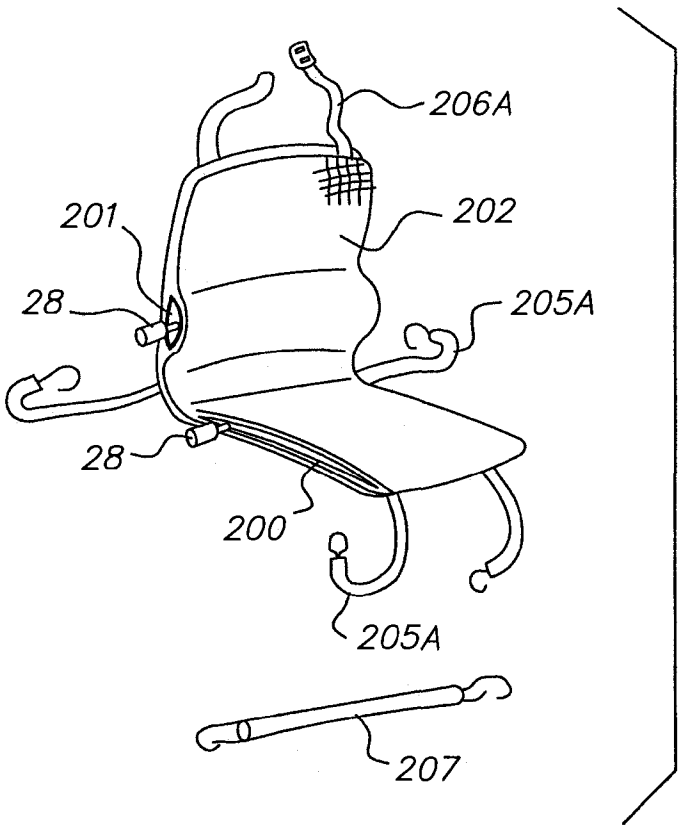
FIG. 2C illustrates an embodiment of my invention intended for use on a vehicle seat.
Figure 2E:
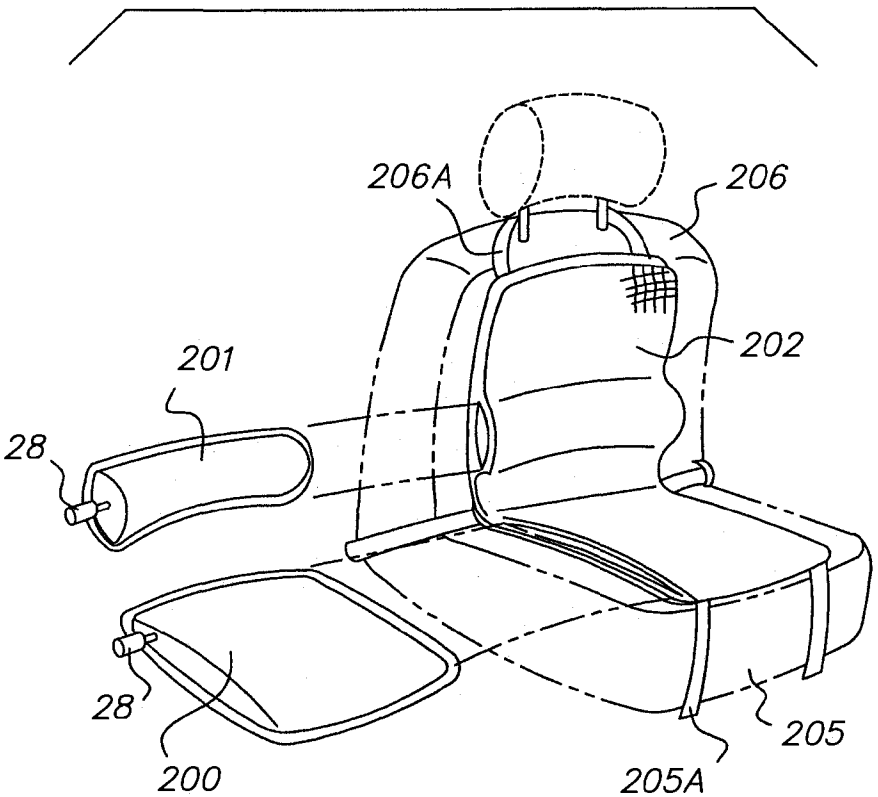
FIG. 2E illustrates an embodiment of my invention intended for use on a vehicle seat.

For seats with backs, as illustrated in FIGS. 2C and 2E, two inflatable members can be used: A lower inflatable member 200 adapted for placement between the seat 205 and the human resting on that seat 205; and a back inflatable member 201 adapted for placement between a back of the human and a back 206 of seat 205. The back inflatable member 201 can be adapted to serve as a lumbar support. In these embodiments as in those set forth above, a receiving structure 202 can be provided that is adapted to hold the inflatable members in correct position with respect to said seat 205, with straps 206A, cords or straps with hooks and/or loops 205A and/or standard shock cords 207 for use in fastening the receiving structure to a seat. Typically, the inflatable member(s) and/or the receiving structures therefor will be shaped and adapted to cover areas appropriate to a particular type of seat such as one of a saddle, a vehicle seat, a motorcycle seat and/or some other type of seat. Thus, another example is provided in FIGS. 2D, 2F and 2G, illustrating embodiments for use with a motorcycle or other vehicle with tandem seating. In the particular embodiment illustrated, where the vehicle rider has an operator's seat 210 and a separate, elevated passenger seat 211, two different pads are provided, an operator's seat pad 212 and a passenger's seat pad 213. These can be provided with loops 212A, 213A for attachment by, e.g., a shock cord 207, and can also be advantageously constructed using the types of non-slip surface materials 212B and core material 212C taught elsewhere herein. As illustrated in FIGS. 5A, 5B and 5C, embodiments 501 adapted to pad the interface between a human limb 500 and a prosthetic 502 are also possible. In this case, the prosthetic pad 501 has fasteners 503 adapted for affixing its at least one inflatable member (501) in position with respect to said prosthetic 502 by, e.g, matching Velcro fasteners 504 on prosthetic 502. Prosthetic pad 501 also has interfacing means, such as Velcro fasteners 505, 506 for wrapping back and fastening onto itself to form a cylindrical shape as illustrated in FIGS. 5A and 5B.

More details on construction design are provided in FIG. 6, an exploded view provides details regarding the preferred use of vinyl trim 601, binding 602, sections of /1;8inch felt with polyester mesh coating 603 and 608, Velcro 604 and 607, /1;4inch felt 605, and 2 inch reinforcement straps 606. However in whatever manner my invention is constructed, it is advantageous to use proportionate valves 28A for valves 28. A proportionate valve 28A can be a spring-loaded valve of the type illustrated in FIGS. 4A, 4C and 4D through 4J. An ordinary valve 48 as illustrated in FIG. 4B has a valve body 80 with a threaded portion 80A on which is mounted a rotating member, screw cap 81. The valve 28 is not adjustable; it can merely be opened or closed by turning screw cap 81. A proportionate valve 28A can, however, be adjusted to different degrees of tightness by rotation of modified screw cap 81'. This is made possible by the inclusion of a biasing spring 82 in proportionate valve 28A and other modifications thereto as shown in FIGS. 4A, 4C and 4D through 4J. At its tightest setting, only a heavy load (or rider) will be sufficient to displace the spring-biased plug 83 and allow air to escape. At its lightest setting, the moderate pressure exerted on the air pad by a light load (or rider) will accomplish this result. Detailed perspective views illustrating a line-up indicator 90 arrangement and illustrating a window 91 scale in FIG. 4A show two manners in which settings for proportionate valve 28A can be made. FIGS. 4C and 4D through 4J illustrate an embodiment having four snap members 84 that snap into two indents 85 when modified screw cap 81' is turned. Modified screw cap 81' has an upper part 81A and a lower part 81B attached by screw-threaded portion 80A to a valve body 80 with an O-ring 80B. The snap indent members 84 of this embodiment not only acts as an indicator of pressure setting, but help to stabilize and prevent undesired rotation of the rotating member/screw cap 81' for this embodiment. They thereby stabilize and prevent unintended change in the pressure setting for the proportionate valve 28A.

I claim:

1. An interface pad, comprising:

at least one inflatable member having a foam core with a cell structure that absorbs atmospheric air, which foam core is wholly surrounded by and bonded to a thin skin which forms a fluid tight envelope around said foam core, which thin skin has an opening for transmitting air between the foam core and the atmosphere, which transmission of air is controlled by a valve in said opening;

fasteners for affixing said at least one inflatable member in a location to serve as an interface pad between a living creature and another object; and wherein said valve is a proportional valve, the proportional valve being adjustable to different pressure settings, which different pressure settings allow air to escape from the valve until the set pressure is reached.

2. An interface pad as described in claim 1, having two inflatable members, a left inflatable member adapted for placement between a left upper side of a load-bearing animal and a load resting on that side and a right inflatable member adapted for placement between a right upper side of the load-bearing animal opposite said left side and a load resting on that side.

3. An interface pad as described in claim 2, further comprising:

a top connection adapted for linking said left inflatable member and said right inflatable member across an upper portion of the load-bearing animal such that said left inflatable member and said right inflatable member hang over said upper portion adjacent, respectively, the left and right upper sides of the load-bearing animal, said top connection being provided by portions of receiving structures holding said left inflatable member and said right inflatable member; and areas covered by said receiving structures conform to a shape appropriate for a particular equine activity such as one of show riding, dressage riding, endurance riding, western riding, barrel racing, roping, racing, hunting, jumping, steeplechase, bareback riding, handicapped riding, pack horse, paraplegic riding, therapeutic riding, and English riding.

4. An interface pad as described in claim 3, wherein said receiving structures are formed from resilient breathable moisture wicking materials with a non-slip breathable material forming a surface portion of the receiving structures, said material including a polyester mesh with PVC coating.

5. An interface pad as described in claim 3, further comprising a strap member for connecting said receiving structures underneath a load-bearing animal and holding the receiving structures in position on the load-bearing animal.

6. An interface pad as described in claim 5, further comprising connection points for a strap member for connecting said receiving structures underneath a load-bearing animal and holding the load pad in position on the load-bearing animal.

7. An interface pad as described in claim 5, wherein a breathable material including a polyester mesh with PVC coating is located between the strap and the load-bearing animal with mesh adjacent the load-bearing animal when the strap is used to hold the load pad in position on a load-bearing animal.

8. An interface pad as described in claim 3, further comprising stirrups.

9. An interface pad as described in claim 3, wherein said inflatable members can be removed from said receiving structures.

10. An interface pad, as described in claim 3, further comprising a connector adapted to bridge a load-bearing animal's withers, which connector is provided with structural reinforcement and can be used as a hand hold.

11. An interface pad, as described in claim 10, further comprising a handle between said connector and the top connection.

12. An interface pad, as described in claim 3, further comprising an expanded skirt, which expanded skirt holds a side inflatable member adapted for placement adjacent a lower side of a load-bearing animal.

13. An interface pad as described in claim 1, wherein said at least one inflatable member is adapted to pad an interface between a human and an object, and said fasteners are adapted for affixing said at least one inflatable member in position adjacent said object.

14. An interface pad as described in claim 13, adapted for use adjacent a seat, said pad having two inflatable members, a lower inflatable member adapted for placement between the seat and the human resting on that seat and a back inflatable member adapted for placement between a back of the human and a back of the seat.

15. An interface pad as described in claim 14, wherein said back inflatable member is adapted to serve as a lumbar support.

16. An interface pad as described in claim 14, wherein said at least one inflatable member is adapted to cover areas appropriate to a vehicle seat such as one of an automobile seat, a motorcycle driver seat, a motorcycle rider seat, and an other vehicle seat.

17. An interface pad as described in claim 13, further comprising a receiving structure adapted to hold said at least one inflatable member in correct position with respect to said object.

18. An interface pad as described in claim 17, wherein said receiving structure is adapted to covers areas appropriate to a particular type of seat such as one of an automobile seat, a motorcycle driver seat, a motorcycle rider seat, and an other vehicle seat.

19. An interface pad as described in claim 13, wherein said at least one inflatable member is adapted to pad an interface between a human and a prosthetic, and the fasteners are adapted for affixing said at least one inflatable member in position with respect to said prosthetic.

20. An interface pad, as described in claim 1, wherein a valve is a proportionate valve, which proportionate valve is adjustable to different pressure settings corresponding to different weight load settings for weight loads to be placed on the inflatable member, which different weight load settings allow air to escape from the proportionate valve until weight load setting pressures are reached, and which different weight load settings inhibit air from escaping from the inflatable member in direct proportion to weight loads placed on the inflatable member.

21. An interface pad, as described in claim 20, wherein said proportionate valve uses a spring member to hold the valve closed and the tension of said spring is adjustable to different pressure settings such that said spring will hold the valve closed only if the pressure exerted by a gas on the valve is not greater than the setting pressure.

22. An interface pad, as described in claim 21, wherein the tension of said spring is adjusted and the pressure set by turning a rotating member.

23. An interface pad, as described in claim 22, wherein said rotating member has a marker that can be moved to correspond to different pressure setting indicators by turning the rotating member.

24. An interface pad, as described in claim 22, wherein said rotating member has snap members that snap into indents when the rotating member is turned.

25. An interface pad as described in claim 1, wherein said at least one inflatable member acts as an orthotic.

26. An interface pad as described in claim 1, further comprising non-slip material placed outwardly of said at least one inflatable member proximate at least one surface of said at least one inflatable member.

27. An interface pad as described in claim 26, wherein said non-slip material includes a polyester mesh with PVC coating, which mesh is oriented outwardly from the at least one inflatable member.

* * * * *